US009573038B1

(12) United States Patent
Hillyard et al.

(10) Patent No.: US 9,573,038 B1
(45) Date of Patent: Feb. 21, 2017

(54) VARIABLE SPEED SWIM SPA SYSTEM

(71) Applicant: Waterway Plastics, Oxnard, CA (US)

(72) Inventors: Jason Hillyard, Fillmore, CA (US); Michael Holtsnider, Moorpark, CA (US)

(73) Assignee: Waterway Plastics, Oxnard, CA (US)

( * ) Notice: Subject to any disclaimer, the term of this patent is extended or adjusted under 35 U.S.C. 154(b) by 0 days.

(21) Appl. No.: 14/878,714

(22) Filed: Oct. 8, 2015

(51) Int. Cl.
*E04H 4/00* (2006.01)
*A63B 69/12* (2006.01)

(52) U.S. Cl.
CPC ..... *A63B 69/125* (2013.01); *E04H 4/00* (2013.01)

(58) Field of Classification Search
CPC ..... A63B 69/125
USPC ..... 4/488–513
See application file for complete search history.

(56) References Cited

U.S. PATENT DOCUMENTS 5,245,714 A * 9/1993 Haraga ..... A61H 33/02 134/22.12
6,003,166 A * 12/1999 Hald ..... A61H 33/6026 137/563
7,526,820 B2 * 5/2009 Murdock ..... A63B 69/125 4/492
7,758,811 B2 * 7/2010 Durack ..... C12N 5/0612 422/67
2004/0002270 A1 * 1/2004 Courtney ..... B63C 9/0005 441/40
2009/0151801 A1 * 6/2009 Gorman ..... F04D 13/14 137/565.11
2013/0031711 A1 * 2/2013 Walsh ..... E04H 4/1209 4/492

* cited by examiner

*Primary Examiner* — Lori Baker
(74) *Attorney, Agent, or Firm* — Sandy Lipkin

(57) ABSTRACT

A variable speed swim spa system wherein the user can choose between a combination of speeds with two or more pumps connected through a manifold to one or more swim jets. Check valves are used on all but the first pump to prevent backflow of water effluent and can be placed inside the manifold or between the pumps and the manifold. A user interface attached to electronic controls and operating software allow the user to program his preferred speeds with the one more jets using the two or more pumps.

6 Claims, 11 Drawing Sheets

60

| Speed Settings for Three Two-Speed Pumps | | |
|---|---|---|
| Pump 1 Speed | Pump 2 Speed | Pump 3 Speed |
| Low Speed | Off | Off |
| Low Speed | Low Speed | Off |
| Low Speed | Low Speed | Low Speed |
| High Speed | Off | Off |
| High Speed | High Speed | Off |
| High Speed | High Speed | High Speed |

62

| Speed Settings for Two Two-Speed Pumps | |
|---|---|
| Pump 1 Speed | Pump 2 Speed |
| Low Speed | Off |
| Low Speed | Low Speed |
| High Speed | High Speed |

VARIABLE SPEED SWIM SPA SYSTEM

BACKGROUND OF THE INVENTION

Field of the Invention

The field of this invention relates generally to the field of swim spas and more specifically toward a system for providing various water flows to a swim spa for the purpose of swimming in pools of all kinds against it at various speeds.

Description of the Prior Art

Variable speed pumps exist for a multitude of purposes but heretofore they have not been utilized for swim spas due to prohibitively high cost. Rather, swim spas in the current art utilize multiple single or two speed pumps and multiple swim jets. Multiple jets can and have been interconnected to a main sample pump. Other prior art teaches the interconnecting of multiple pumps to a single system wherein some pumps could be on while other are off, where check valves are used between the pumps and the interconnection to the common system in order to prevent the back flow of water from the pumps that are on to the pumps that are off. Furthermore, prior art systems that are propeller driven cannot use standard swim jets and therefore require a great deal of construction and specialized tooling. Prior art systems that utilize swim spa systems that are driven by infinitely variable speed centrifugal pumps require an extra component, i.e., a speed modifying inverter that adds to the complexity of installation and maintenance.

It is the object of the instant invention to provide a more affordable system that provides variable water flow to a swim spa for the purpose of swimming in pools of all kinds against the flow at various speeds as desired.

It is yet another object of the instant invention to provide the ability to use standard swim jets on existing systems.

It is yet another object of the instant invention to eliminate the need for a speed modifying inverter as required in infinitely variable speed centrifugal driven swim spa systems.

SUMMARY OF THE INVENTION

The basic embodiment of the present invention teaches a variable speed swim spa system comprising: a first water pump with water effluent flowing therefrom, said first water pump have one or two speeds; one or more additional water pumps with water effluent flowing therefrom, said one or more additional water pump each having one or two speeds; a manifold into which said effluent water flows from said first water pump and said one or more additional water pumps; one or more check valves connected to said one or more additional water pumps to prevent back flow of water into said one or more additional water pumps; one or more swim jets through which said water effluent flows from said manifold; and a user interface with software to control the powering on and off of the system as well as the sequencing and speed of said first water pump and the sequencing and speed of said one or more additional water pumps to create three or more combined water flow rates.

The above embodiment can be further modified by defining that the manifold has inlet ports that correspond to each of said first water pump and said one or more additional water pumps and outlet ports that correspond to each of said first water pump and said one or more additional water pumps wherein said inlet ports are misaligned from said outlet ports in order to provide balanced effluent water flow therefrom.

The above embodiment can be further modified by defining that said user interface is controlled by software that keeps said first pump flowing whenever the system is in use.

The above embodiment can be further modified by defining that said one or check valves are housed inside of said manifold.

The above embodiment can be further modified by defining that said user interface and said software is preprogrammed or programmable by a user with exercise routine circuits.

The above embodiment can be further modified by defining that said system is self-contained and portable.

The above embodiment can be further modified by defining that said first water pump has no check valve as said software requires said first water pump to be powered on at the same speed as any of the said one or more additional pumps.

An alternate embodiment of the instant invention teaches a variable speed swim spa system comprising: a first water pump with water effluent flowing therefrom, said first water pump having one or two speeds; one or more additional water pumps with water effluent flowing therefrom, said one or more additional water pumps each having one ore two speeds; a manifold into which said effluent water flows from said first water pump and said one or more additional water pumps; one or more check valves connected to said first water pump and said one or more additional water pumps to prevent back flow of water into said one or more additional water pumps; one or more swim jets though which said water effluent flows from said manifold; and a user interface with software to control the powering on and off of the system as well as the sequencing and speed of said first water pump and the sequencing and speed of said one or more additional water pumps to create three or more combined water flow rates.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
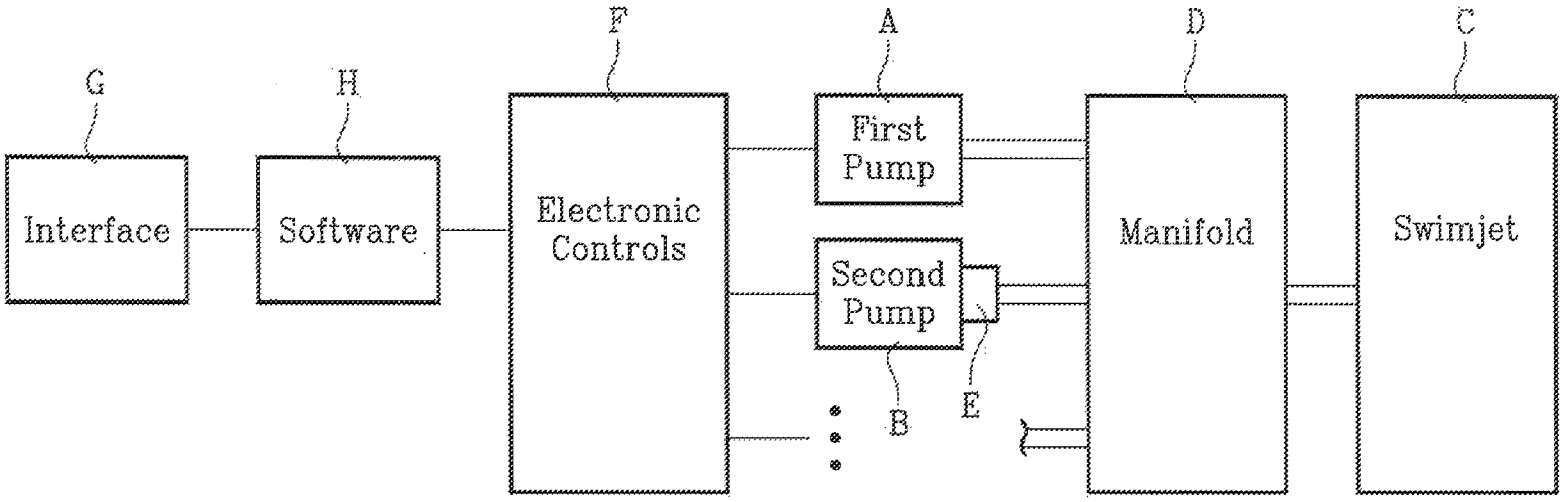
FIG. 1 shows a schematic drawing of the swim spa system of the instant invention.

Turning to the drawings, the preferred embodiment is illustrated and described by reference characters that denote similar elements throughout the several views of the instant invention.

The preferred embodiment provides for a novel system that is outlined schematically in FIG. 1. In this schematic diagram, the various elements are described as follows: A: first pump; B: second pump (and the number of pumps is scalable); C: swim jet; D manifold; E: check valve: F: electronic controls; G: user interface; and H: operating software. The swim jet C that the user will swim against is connected to a manifold D. More than one swim jet can be used but for purposes of illustration we will describe only one. The manifold D interconnects effluent water from two or more single or two-speed centrifugal water pumps A, B to supply water to the swim jet C or jets. It is preferred that the manifold provides balanced flow to each outlet of the manifold. Balanced flow can be achieved by baffling or by creating turbulence. The preferred embodiment of the manifold has three inlet ports and three outlet ports, wherein the inlet ports are misaligned by 60 degrees from the outlet ports so that the water flow is balanced between the three outlet ports. The balanced flow is achieved by creating turbulent flow within the manifold that discourages the channeling or biasing water flow to one outlet port over another outlet port.

Check valve E is connected between the manifold D and pump B as well as each additional pump to prevent water from back flowing to the pump B when it is not in use. The misalignment prevents problems from occurring at lower system pressures wherein more water may be directed to one particular swim jet over another. A check valve is not required between pump A and the manifold D because the system is designed so that the software requires pump A to always be running at the same pressure as any other pump that is running. Because pump A will always be running when another pump is running, there will be no need for a check valve between pump A and the manifold D. Check valves can also be housed at the water inlet inside of the manifold D (see FIG. 5). Electronic controls F that individually control each pump A, B are placed schematically between the pumps A, B and a user interface G that allows the user to select between the two or more water flows to swim against. A software program H works with the interface G to relate the user's water flow choice to operate one or more of the pumps A, B to provide the user selected flow of water to the swim jet C or jets by way of the manifold D.

Figure 2:
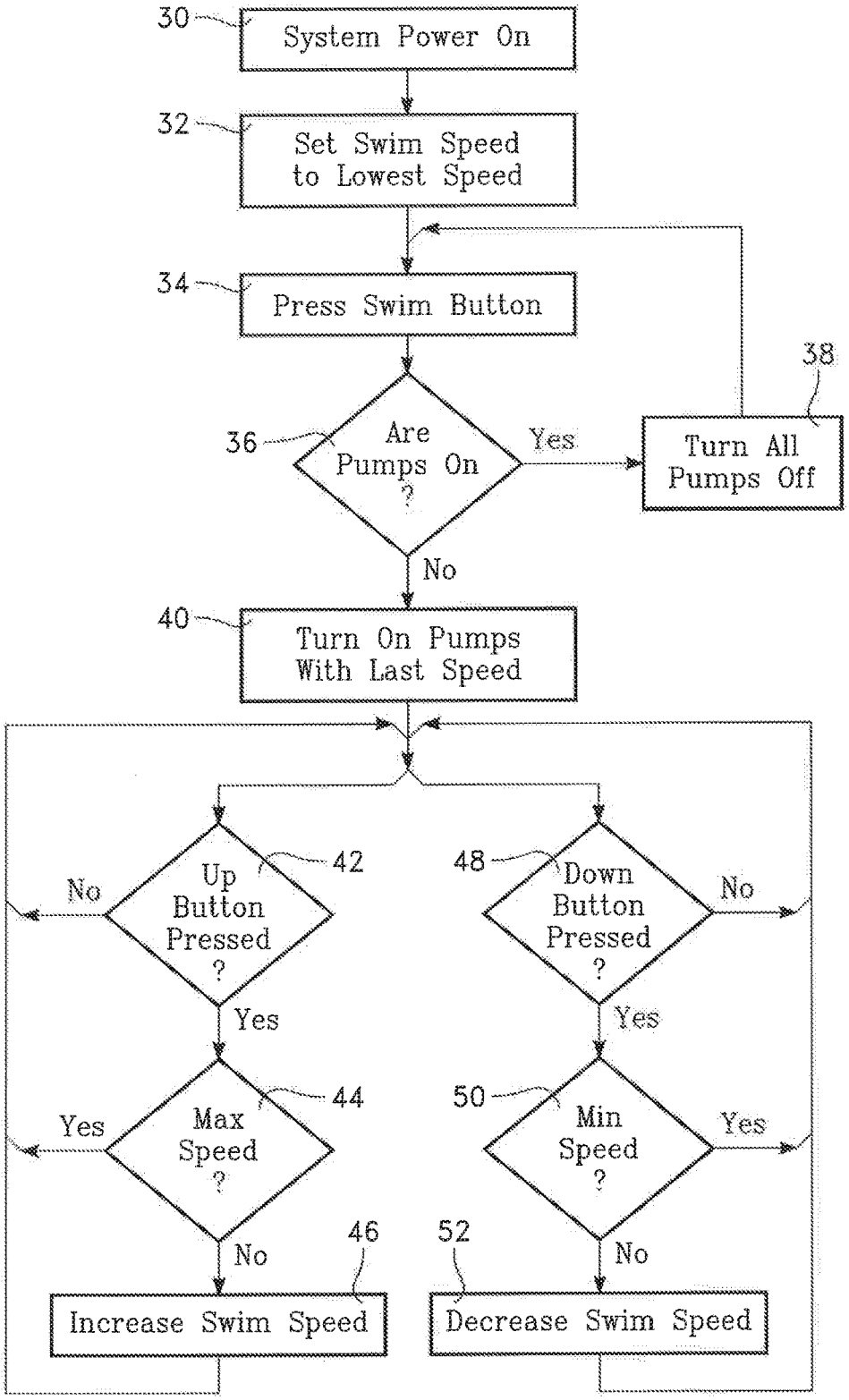
FIG. 2 shows a flow chart for the interface controls of the instant invention.
Figure 2A:
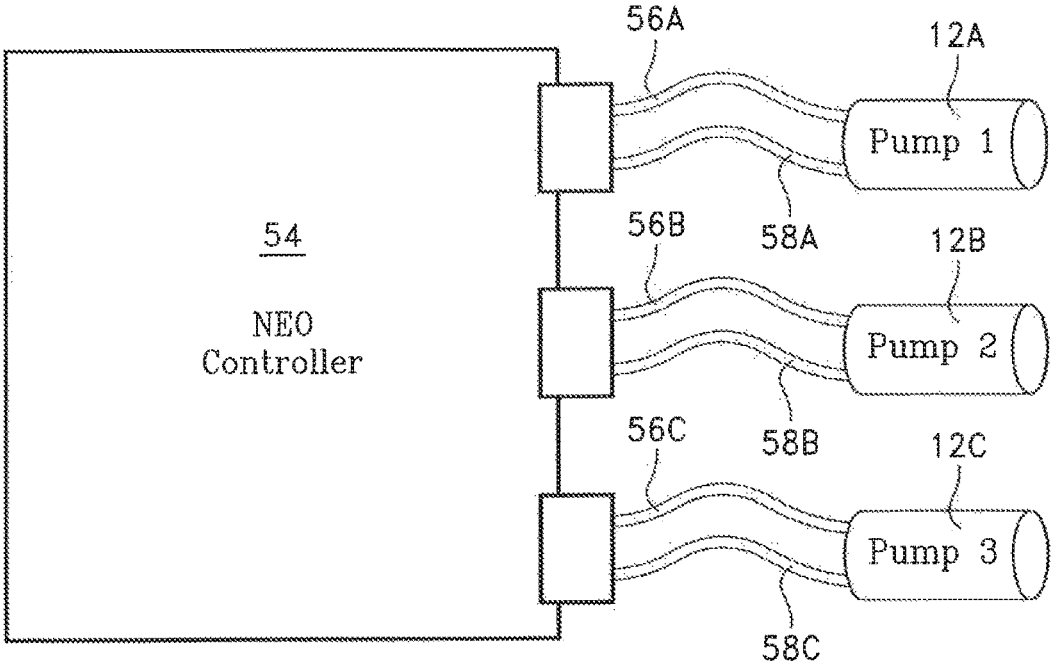
FIG. 2A shows a schematic diagram of the controller of the instant invention utilizing three pumps.
Figure 3:
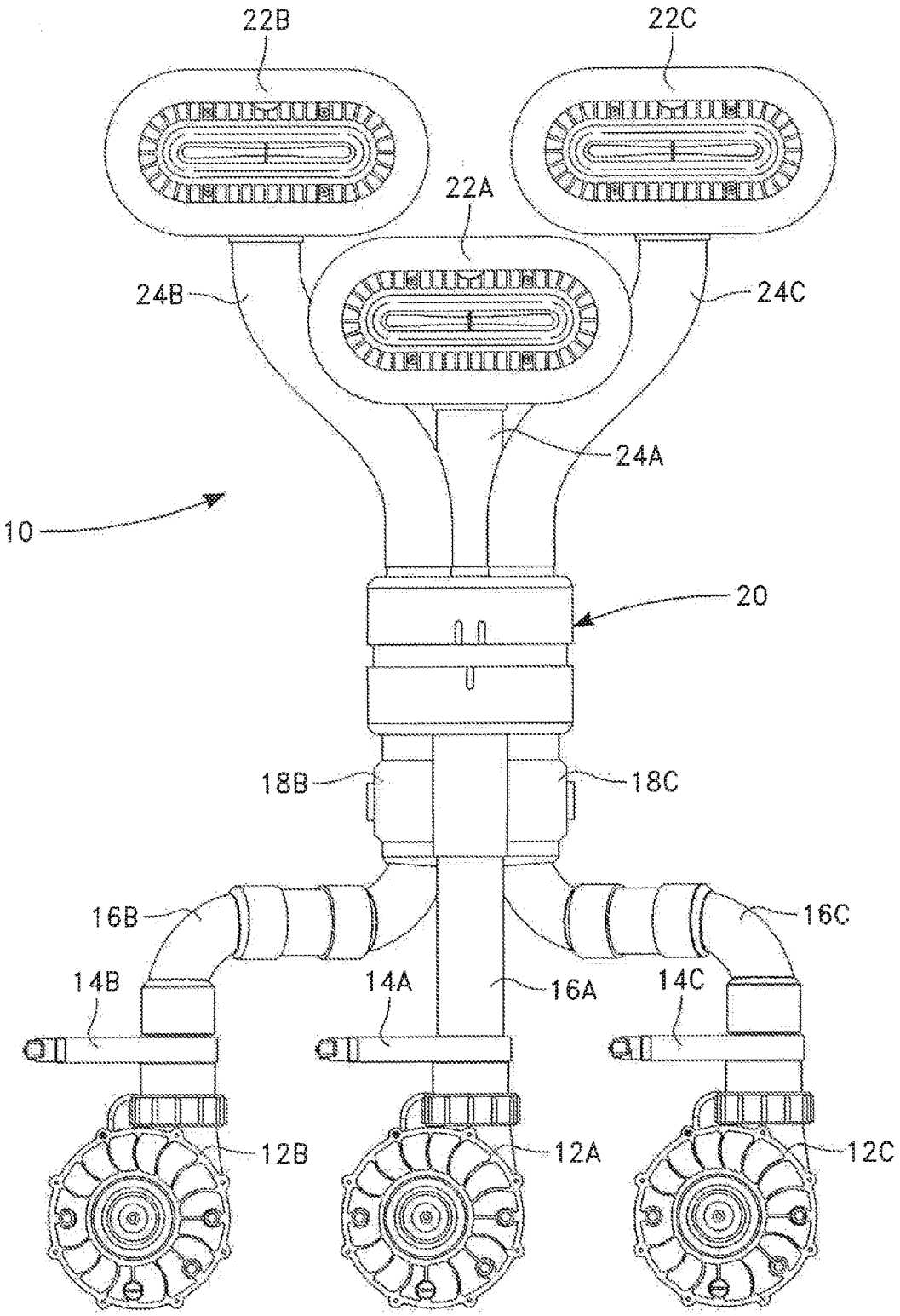
FIG. 3 shows a front view of the apparatus of the instant invention connecting three pumps to three swim jets.
Figure 3A:
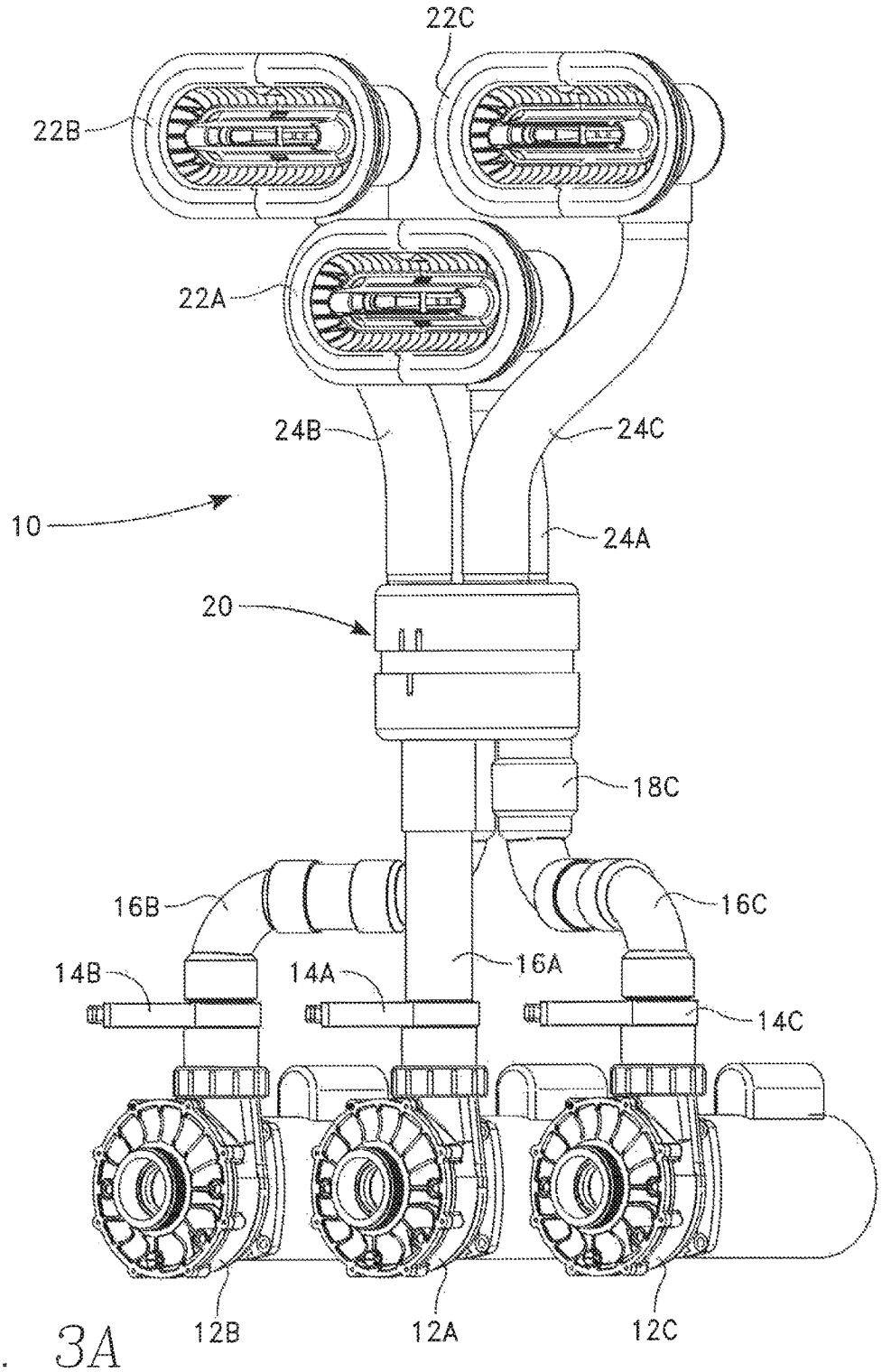
FIG. 3A shows a front perspective view of the apparatus of the instant invention connecting three pumps to three swim jets.
Figure 3B:
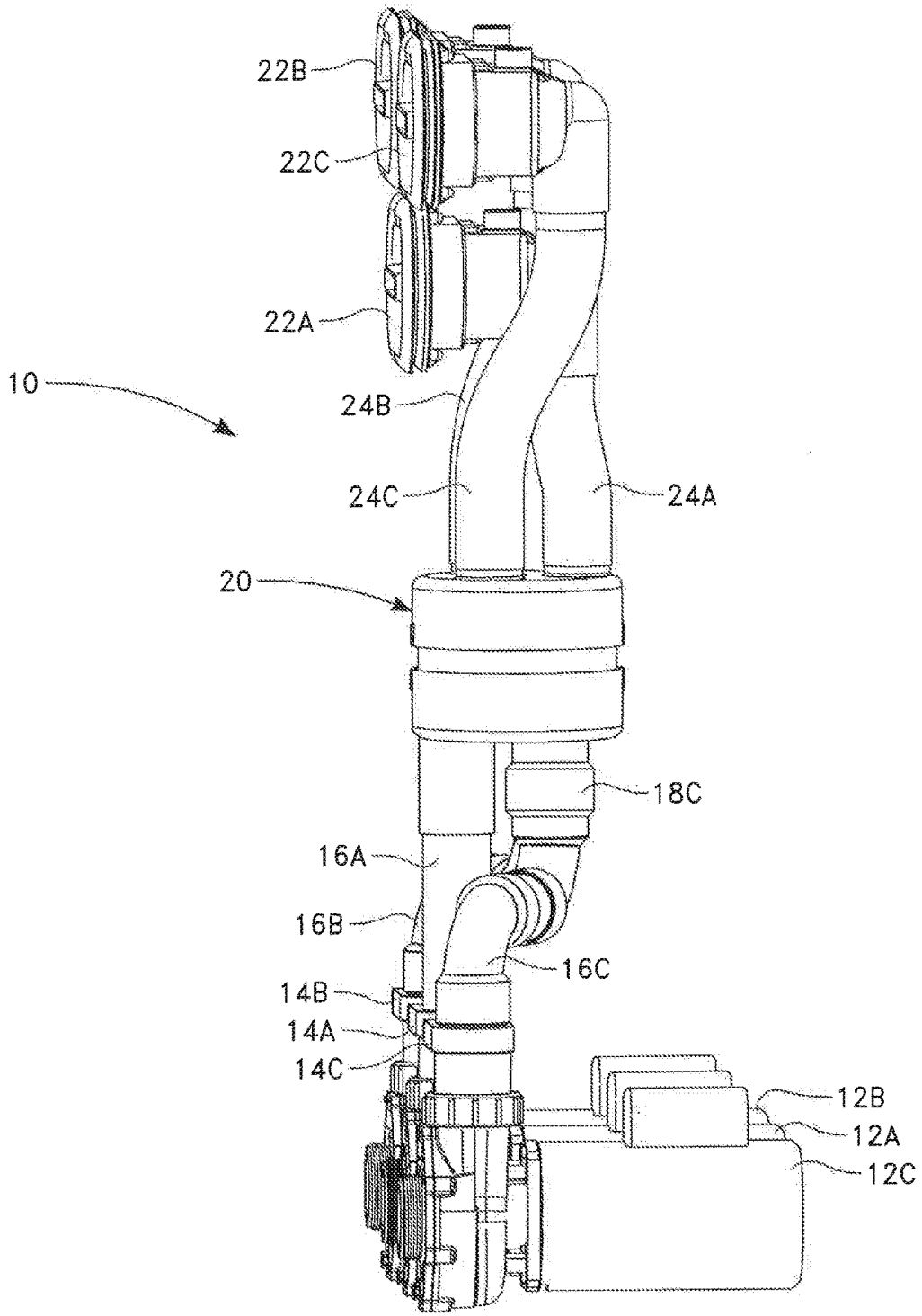
FIG. 3B shows a side view of the apparatus of the instant invention connecting three pumps to three swim jets.
Figure 4:
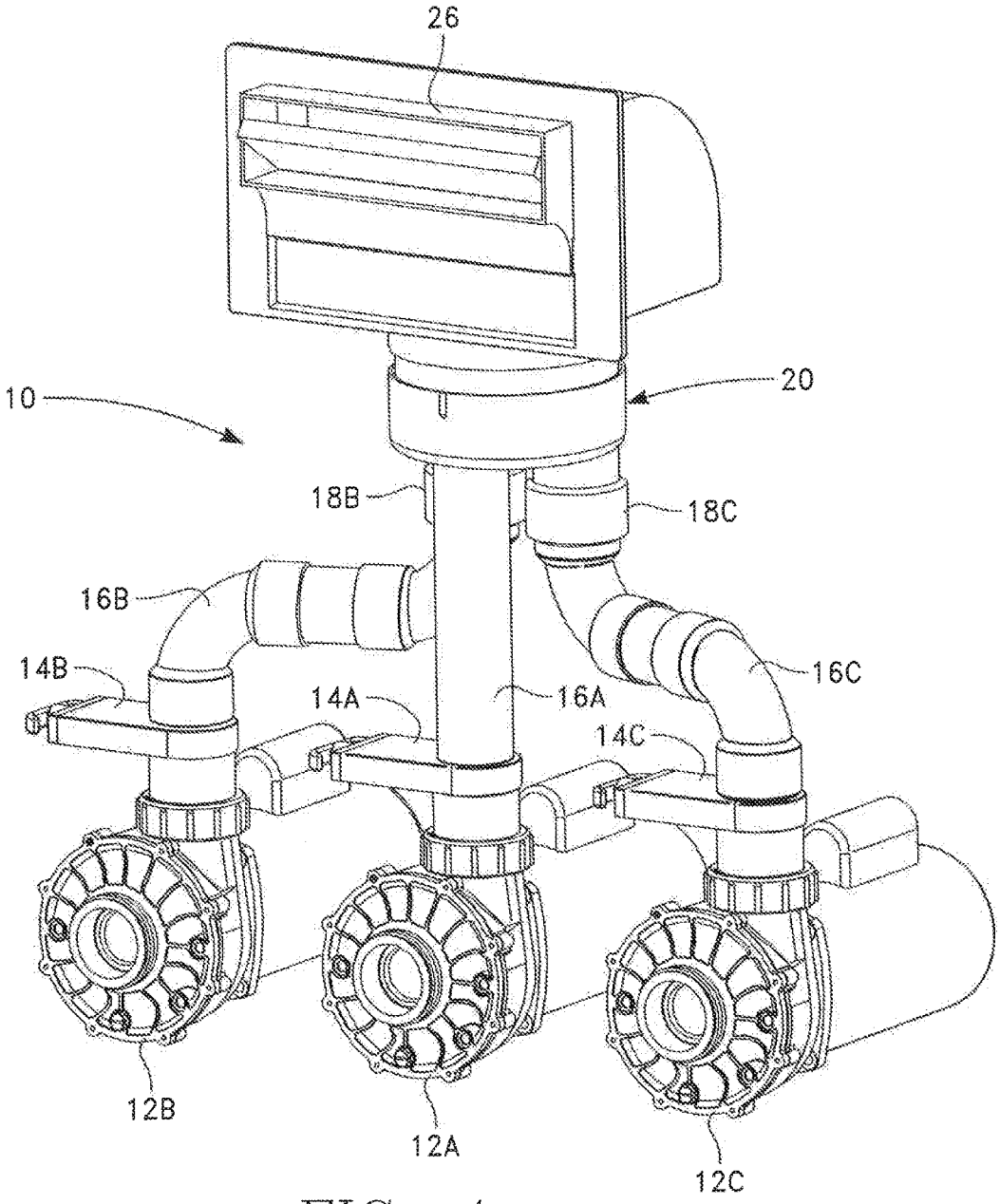
FIG. 4 shows a front perspective view of an alternate embodiment of the apparatus of the instant invention connecting three pumps to a single swim jet.

FIGS. 2 and 2A explain how the controls work in the flow chart (FIG. 2) and schematically in the schematic diagram (FIG. 2A). The controller 54 controls three two-speed pumps 12A, 12B, 12C (in the preferred embodiment as shown in FIGS. 3-4. Each pump 12A, 12B, 12C can be controlled with the controller 54 to operate at either a high speed 56A, 56B. 56C or a low speed 58A, 58B, 58C. The combinations provided in speed are outlined in Table 60 in FIG. 2A. A similar table for just two pumps is shown in Table 62 in FIG. 2A.

To use with 3 pumps 12A, 12B, 12C there is a potential of up to 9 different swim speeds. With the use of only two pumps 12A, 12C, there is a potential of up to 4 speeds. A more detailed explanation of the actions is displayed as well. The swim button is pressed 34. The system checks itself to see if it is on 36. If it is on, all of the pumps are turned off 38. It is not on, the pumps are turned on to their last speed 40. There is an up button and a down button. If the up button is pressed 42, then the system can go up to its maximum speed 44. If it is not already there, the speed can be increased 46. If it is already at is maximum then only the down button can be pressed 48. Once the down button is pressed 48 the system checks to see if it is at is minimum speed 50. If not, then the speed can be decreased 52. If so, then it can only be increased.

Figure 3C:
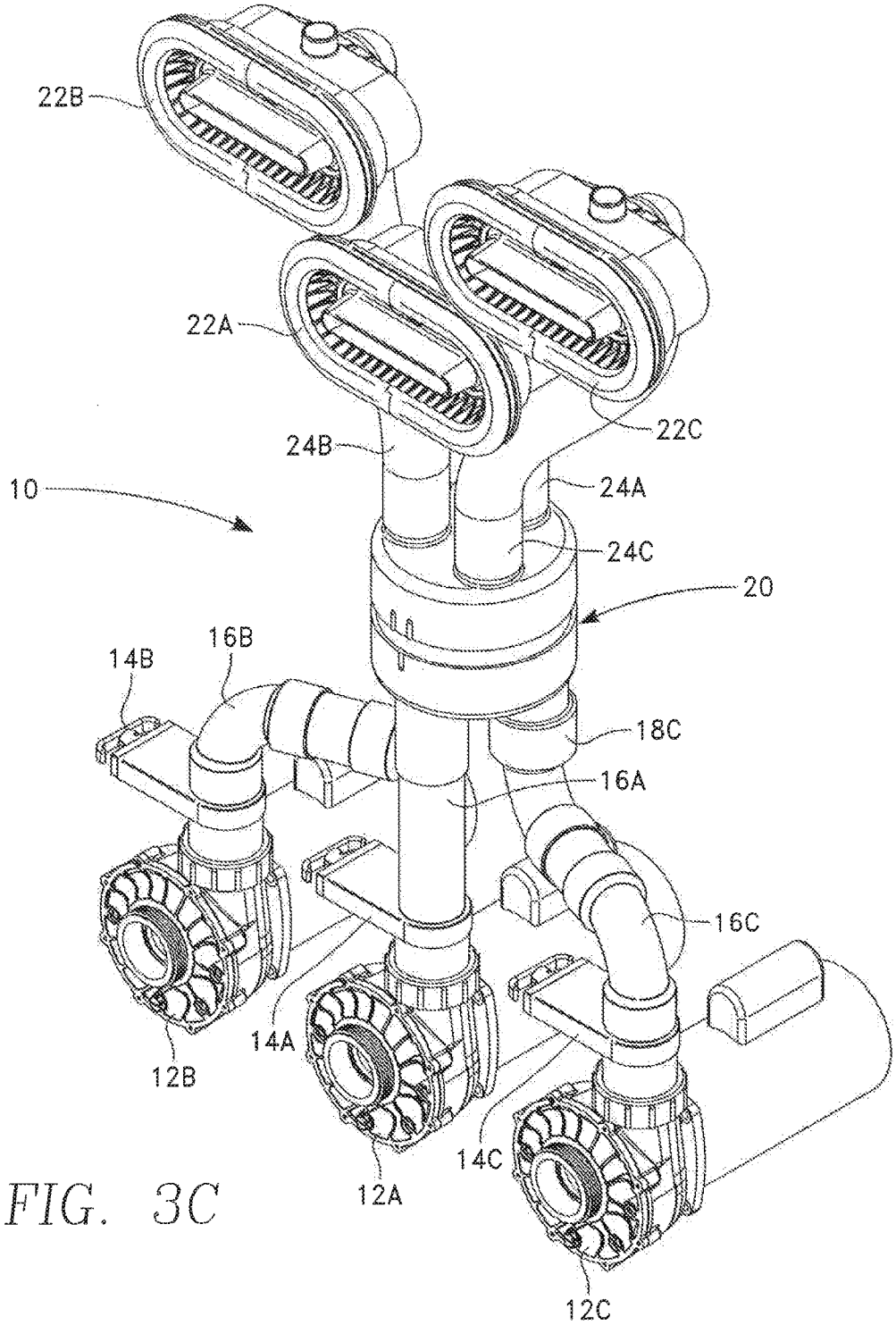
FIG. 3C shows a top perspective view of the apparatus of the instant invention connecting three pumps to three swim jets.

The apparatus 10 that runs the system is shown in FIGS. 3-4. The preferred embodiment is shown in FIGS. 3-3C wherein there are three pumps 12A, 12B, 12C and three swim jets 22A, 22B, 22C. The pumps 12A, 12B, 12C are connected to conduits 16A, 16B, 16C. Between the pumps 12A, 12B, 12C and the conduits 16A, 16B, 16C are isolation/slice valves 14A, 14B, 14C that are used to service the pumps 12A, 12B, 12C and are not part of the novel aspect of this invention. In the preferred embodiment two of the three pumps, i.e., 12B and 12C each have a check valve 18B, 18C to prevent back flow into the pumps 12B, 12C. Pump 12A located in the center between pumps 12B and 12C is plumbed without a check valve directly to the manifold.

The conduits 16A, 16B, 16C meet at the manifold 20. From the manifold 20, in the preferred embodiment, three conduits 24A, 24B, 24C emerge that are each connected to a swim jet 22A, 22B, 22C. The combination of speeds from the pumps 12A, 12B, 12C as they exit the swim jets 22A, 22B, 22C is what creates the variable speed swim spa system.

Figure 5:
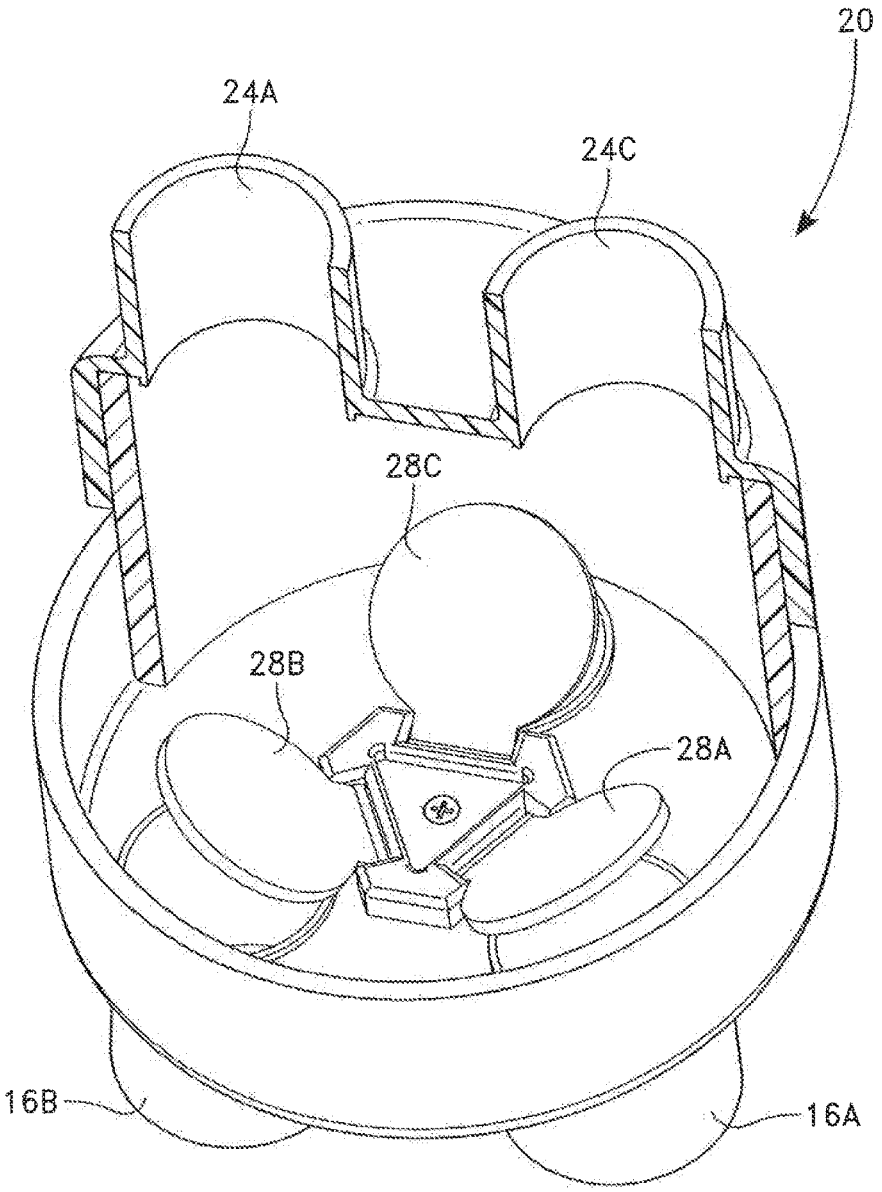
FIG. 5 shows an interior view of the manifold of the instant invention wherein the check valves are housed internally of the manifold.

FIG. 4 shows an alternate embodiment wherein the three pumps 12A, 12B, 12C connect the manifold 20 in the same was the preferred embodiment, but wherein from this manifold 20 only a single jet 26 emerges. FIG. 5 shows an embodiment of the manifold 20 wherein the check valves 28A, 28B, 28C are internal rather than placed between the pumps 12B, 12C and the manifold 20. This will allow for the omission of the check valves 18B, 18C as shown in FIGS. 3-4.

One of the advantages of this swim jet system vs. a propeller system is that the swim jets 22A, 22B, 22C, 26 can be placed on flat walls, i.e., standard jet mounting styles, while propeller systems are held in custom niches that are molded into the spa substrate and covered with a grate. The instant invention can be used on standard swim spas without reworking the vacuum forms used to form the substrate. Further, swim jets 22A, 22B, 22C, 26 allow for air induction, via venturi, into the water stream that can amplify the stream of water from the jet 22A, 22B, 22C, 26. This is not feasible with prior art propeller systems.

The pumps 12A, 12B, 12C of the instant invention do not have an inverter that is required is some prior art systems. The manifold of the instant invention combines the flows of various running pumps 12A, 12B, 12C to create more variation than a single pump is capable of providing a swim jet 26 or bank of swim jets 22A, 22B, 22C. The pumps 12A, 12B, 12C in the instant invention are not infinitely variable. There are set flow rates for this system based on pump choices and software pump sequencing. This system does not require the inverter that is required on or is included with infinitely variable pumps.

The instant invention utilizes economical single or 2-speed pumps 12A, 12B, 12C, electronic controls with user interface controlled by customized software (see FIGS. 1-2A) connected to the swim spa through the manifold 20. Check valves 18B, 18C, 28A, 28B, 28C prevent flow from the effluent flow from the operable pump or pumps from back flowing to the non-operable pumps and the system achieves variable flows at very low cost. The user can adjust all the jets simultaneously, with up to 6 speeds, allowing for gentle low buoyancy aerobics, aggressive swimming, and any desired flow in between. In the preferred embodiment, however, the system is scalable.

The control system controls the sequence of each pump. For example, when using two pumps, the following sequence is possible. First speed—first pump actuates on low speed equaling roughly 140 GMP, the second speed from the combination of the first pump and the second pump actuates on low speed equaling roughly 250 GPM. A third speed wherein the first pump actuates on high speed equaling roughly 290 GPM and so forth. Below is a table that shows the possibilities for a two-pump system followed by the possibilities for a 3 pump system, which can be extended out to as many pumps as desired.

| System Speed/2 Pump System | Pump | Pump Speed | Flow/Jet GPM | Total System Flow |
|---|---|---|---|---|
| 1 | P1 | Low | 45 | 135 |
| 2 | P1 & P2 | Low | 85 | 255 |
| 3 | P1 | High | 95 | 534 |
| 4 | P1 & P2 | High | 178 | 534 |

| System Speed/3 Pump System | Pump | Pump Speed | Flow/Jet GMP | Total System Flow |
|---|---|---|---|---|
| 1 | P1 | Low | 45 | 135 |
| 2 | P1 & P2 | Low | 85 | 255 |
| 3 | P1 | High | 95 | 285 |
| 4 | P1 & P2 & P3 | Low | 118 | 354 |
| 5 | P1 & P2 | High | 178 | 534 |
| 6 | P1 & P2 & P3 | High | 245 | 735 |

The flow from all pumps are mixed together in the manifold and then evenly re-distributed to each of the swim jets.

The manifold can also have a single outlet connected directly to one large swim jet as shown in FIG. 4.

The software can also be preprogrammed or programmable by the user with exercise routines also referred to as circuits. One example of a preferred embodiment of the circuit may include: a segment of the circuit with a speed for warming up muscles for a specified period of time, a main segment of the circuit with constant or varying speeds for specified times, and a cool down segment with a specific speed for a specified time. The various segments could be indicated through lighting sequences to indicate changes in segments. Music may be added to the circuit.

Data and information may be measured and retained about specific users of the swim spa. Some data may be collected through the use of a peripheral device such as a smart watch or smart ring. The information and data collected from the peripheral device could include the number of swim strokes, a step count or a pulse rate. This data may be aggregated along with data collected from the device of the instant invention, such as water current speed and water temperature. It may also be possible to discern breath counts by variances in stroke patterns and rates. It may be beneficial to collect certain information, such as heart rate before, during and after the exercise routine circuit. Such information would be beneficial in determining a resting heart rate and to perform testing akin to an exercise stress test. The aggregated information may then provide lap counts, total laps, and heart recovery rate, as well as long term performance data.

Figure 7:
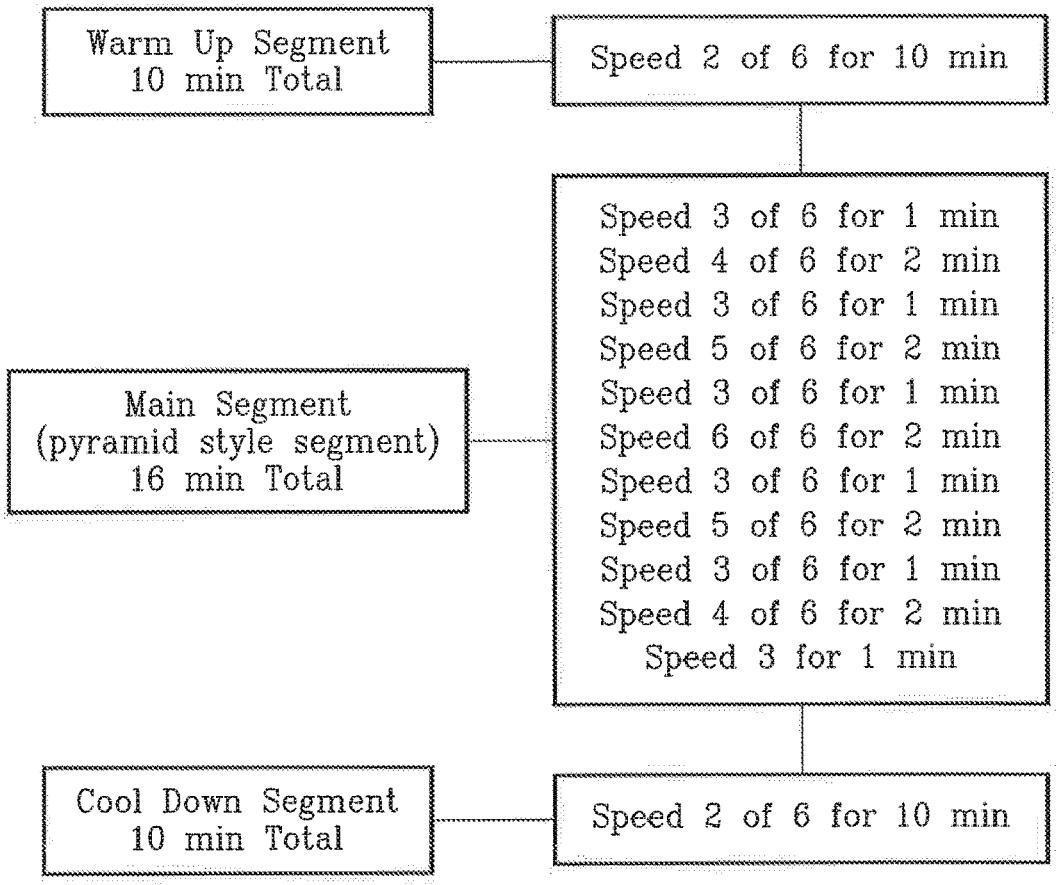
FIG. 7 shows a flow diagram of an example of a computerized exercise circuit that could be programmed into the software of the instant invention.

An example of an exercise circuit routine that could be programmed into the software of the instant invention is illustrated in the flow chart of FIG. 7.

Figure 6:
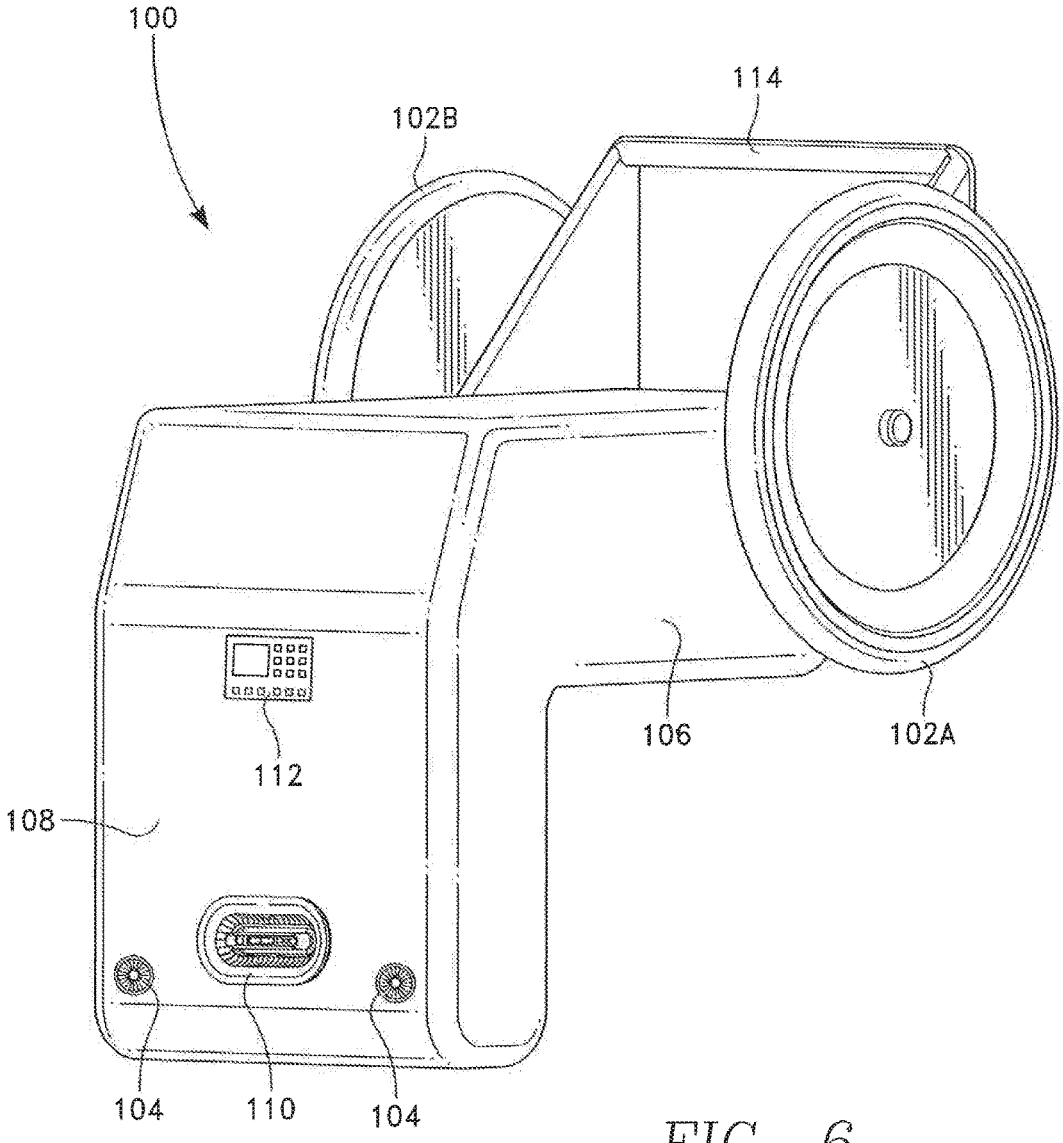
FIG. 6 shows a perspective view of the exterior of a portable embodiment of the instant invention.

The system may be adapted with an outer casing to make the system self-contained and portable. A portable unit 100 is illustrated in FIG. 6 and can be transferred and used over the side of an existing pool. The unit 100 includes wheels 102A, 102B that allow it to roll along the side of a pool. There are entries 104 for the inflow of pressurized water from the pumps. There is a portion 106 that houses the manifold and inner workings of the system as defined in the preferred embodiment. A third portion 108 hangs over the side of the pool that has an outlet 110 for the swim jet or jets. There is a handle 114 for ease of portability. The user interface 112 is located on the third portion 108 that hangs into the pool for ease of access by the user.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A variable speed swim spa system comprising:

a first water pump with water effluent flowing therefrom, said first water pump having one or two speeds;

one or more additional water pumps with water effluent flowing therefrom, said one or more additional water pump each having one or two speeds;

a manifold into which said effluent water flows from said first water pump and said one or more additional water pumps;

one or more check valves connected to said one or more additional water pumps to prevent back flow of water into said one or more additional water pumps;

one or more swim jets through which said water effluent flows from said manifold; and a user interface with software to control the powering on and off of the system as well as the sequencing and speed of said first water pump and the sequencing and speed of said one or more additional water pumps to create three or more combined water flow rates wherein said first water pump requires no check valve as said software requires said first water pump to be powered on at the same speed as any of the said one or more additional pumps.

2. The variable speed swim spa system as defined in claim 1 wherein the manifold has inlet ports that correspond to each of said first water pump and said one or more additional water pumps and outlet ports that correspond to each of said first water pump and said one or more additional water pumps wherein said inlet ports are misaligned from said outlet ports in order to provide balanced effluent water flow therefrom.

3. The variable speed swim spa system as defined in claim 1 wherein said user interface is controlled by software that keeps said first pump flowing whenever the system is in use.

4. The variable speed swim spa system as defined in claim 1 wherein said one or more check valves are housed inside of said manifold.

5. The variable speed swim spa system as defined in claim 1 wherein said user interface and said software is preprogrammed or programmable by a user with exercise routine circuits.

6. The variable speed swim spa system as defined in claim 1 wherein said system is self-contained and portable.

* * * * *